US006355857B1

(12) United States Patent
Wagner

(10) Patent No.: US 6,355,857 B1
(45) Date of Patent: Mar. 12, 2002

(54) METAL ALLOY TREATMENT PROCESS FOR RADIOACTIVE WASTE

(75) Inventor: Anthony S. Wagner, Bee Caves, TX (US)

(73) Assignee: Clean Technologies International Corporation, Lakeway, TX (US)

( * ) Notice: Subject to any disclaimer, the term of this patent is extended or adjusted under 35 U.S.C. 154(b) by 0 days.

(21) Appl. No.: 09/334,985

(22) Filed: Jun. 17, 1999

(51) Int. Cl.[7] ..... G21F 9/00
(52) U.S. Cl. ..... 588/15; 588/252
(58) Field of Search ..... 588/1, 2, 15, 18, 588/20, 201, 249, 252, 261, 901; 205/505.1, 506.1, 507.1, 515.1, 518.1; 252/625; 376/277, 287, 288, 289, 290

(56) References Cited

U.S. PATENT DOCUMENTS 4,236,163 A 11/1980 Ross
4,300,056 A 11/1981 Gagneraud
4,571,307 A 2/1986 Bonnaiud et al.
5,592,027 A * 1/1997 Jacq et al. ..... 264/0.5
5,640,702 A 6/1997 Shultz
5,678,236 A 10/1997 Macedo et al.
5,814,824 A 9/1998 Hamby et al.

FOREIGN PATENT DOCUMENTS

GB 1446016 * 8/1976 ..... G21F/9/30

* cited by examiner

*Primary Examiner*—Steven P. Griffin
*Assistant Examiner*—Eileen E. Nave
(74) *Attorney, Agent, or Firm*—Russell D. Culbertson; Shaffer & Culbertson, L.L.P.

(57) ABSTRACT

A waste treatment process includes containing a reactant metal alloy (210) in a reactant alloy container (202) substantially isolated from oxygen gas. The reactant metal alloy includes at least one chemically active alkaline metal and at least one radiation absorbing metal. After heating the reactant alloy (210) in the reactant alloy container (202) to a desired operating temperature, a waste material including radioactive isotopes to be alloyed is introduced into the molten alloy, preferably below the surface of the alloy. Non-radioactive compounds in the waste material react with metals in the reactant alloy (210) to produce useful halogen salts and other materials. The metal radioactive isotopes in the waste material are alloyed with the alkaline metal and radiation absorbing metals to create a storage product for long term storage.

12 Claims, 2 Drawing Sheets

METAL ALLOY TREATMENT PROCESS FOR RADIOACTIVE WASTE

CROSS REFERENCE TO RELATED APPLICATIONS

This application is related to U.S. patent application Ser. No. 09/096,617, filed Jun. 12, 1998, entitled "REACTANT METAL ALLOY TREATMENT PROCESS FOR RADIOACTIVE WASTE" (As Amended), now abandoned, and is also related to U.S. patent application Ser. No. 09/274,583, filed Mar. 23, 1999, now U.S. Pat. No. 6,195,382, entitled "HIGH TEMPERATURE MOLTEN METAL REACTOR AND WASTE TREATMENT PROCESS." The disclosure of each of these two related applications is incorporated herein by this reference.

TECHNICAL FIELD OF THE INVENTION

This invention relates to a waste treatment process utilizing molten metals. More particularly, the invention relates to a treatment process utilizing molten metals to react chemically with certain waste materials in a waste stream and to alloy radioactive isotopes in the waste stream.

BACKGROUND OF THE INVENTION

Many waste treatment processes utilize thermal energy to break up waste materials into their constituent elements or more desirable compounds. The use of thermal energy to break down materials is referred to generally as pyrolization. Molten metals have also been used to react with certain waste materials in order to produce more desirable compounds or reduce the waste to constituent elements. In particular, molten aluminum has been used to react with halogenated hydrocarbons and produce aluminum salts. U.S. Pat. No. 4,469,661 to Shultz described the destruction of PCBs and other halogenated hydrocarbons by contacting the hydrocarbon vapor with molten aluminum. The aluminum was contained in low-boiling eutectic mixtures of aluminum and zinc or aluminum, zinc, and magnesium. Shultz also suggested eutectic reactant mixtures containing iron, calcium, and other metals. U.S. Pat. No. 5,640,702 to Shultz disclosed a molten metal treatment for wastes containing radioactive constituents. This patent to Shultz disclosed using lead in the molten reactant metal as a chemically active material for reacting with non-radioactive constituents in the waste to be treated.

U.S. Pat. No. 5,000,101 to Wagner disclosed a process for treating hazardous waste material with molten alkaline metal alloys. The molten metal alloy comprised approximately 50% aluminum, 5% to 15% calcium, 5% to 15% copper, 5% to 15% iron, and 5% to 15 zinc. U.S. Pat. No. 5,167,919 to Wagner disclosed a reactant alkaline metal alloy composition comprising between 40% to 95% aluminum, 1% to 25% iron, 1% to 25% calcium, 1% to 25% copper, and 1% to 25 % zinc. The '919 Wagner patent also disclosed that magnesium could be substituted for calcium. In both of these Wagner patents, the waste material was reacted in the molten alloy held at about 800 degrees Celsius.

In the process disclosed in the above-described Wagner patents, chlorine atoms in the waste material were stripped from the waste compound primarily by the highly reactive aluminum in the molten reactant alloy. The aluminum and chlorine combined to form aluminum chloride. Carbon from the original waste compound was liberated either in elemental form or as char (CH, $CH_2$, or $CH_3$). Both the aluminum chloride and liberated carbon sublimed to a gaseous state at the 800 degree Celsius reaction temperature and were drawn off and separated.

Many hazardous waste sites have different types of wastes mixed together. The mixed waste may include numerous different types of halogenated hydrocarbons, other non-radioactive wastes, and radioactive isotopes. These mixed wastes which include radioactive and non-radioactive materials have proven particularly difficult to treat. Although, many non-radioactive wastes may be treated chemically and broken down into benign or less hazardous chemicals, radioactive constituents of the mixed waste stream cannot be manipulated to reduce or eliminate their radioactive emissions. It is desirable to separate the radioactive constituents from the other materials in the mixed waste and place the radioactive constituents in an arrangement for safe, long term storage.

Storing radioactive waste poses several problems in itself. For a radioactive isotope which has a long half life, a quantity of the material remains radioactive for many years. Thus, a storage arrangement for this long-lived radioactive waste must be capable of securely holding the waste for a very long period of time. However, radioactive emissions, particularly alpha radiation, can interact with the material of a container intended to store radioactive waste. This interaction can cause the container to degrade relatively quickly, long before the radioactive waste itself has degraded.

SUMMARY OF THE INVENTION

It is an object of the invention to provide a waste treatment process for treating radioactive waste materials, particularly mixed waste streams which include both non-radioactive wastes and radioactive constituents.

The waste treatment process according to the invention utilizes a molten reactant metal alloy including at least one chemically active metal for reacting with the non-radioactive material in the mixed waste stream being treated. The reactant alloy also includes at least one radiation absorbing metal. Radioactive isotopes in the waste stream alloy with the chemically active and radiation absorbing metals such that the radiation absorbing metals are able to absorb a significant portion of the radioactive emissions associated with the isotopes. Non-radioactive constituents in the waste material are broken down into harmless and useful constituents, leaving the alloyed radioactive isotopes in the molten reactant alloy. The reactant alloy may then be cooled to form one or more ingots in which the radioactive isotopes are effectively isolated and surrounded by the radiation absorbing metals. The ingots may be encapsulated in one or more layers of radiation absorbing material and then stored.

The chemically active metal in the reactant alloy may comprise any metal capable of reacting chemically with one or more non-radioactive constituents in the waste stream. Preferred chemically active metals include magnesium, aluminum, lithium, zinc, calcium, and copper. In the preferred form of the invention, a combination of these metals is included in the reactant alloy. The particular chemically active metal or combination of chemically active metals used in a particular application will depend upon the makeup of the wastes in the waste stream and the reaction products which are desired from the treatment process.

Each radiation absorbing metal included in the reactant alloy is matched with a particular radioactive isotope to be alloyed with the metals in the molten metal bath. That is, for each type of expected radioactive emission associated with a radioactive isotope to be alloyed, a radiation absorbing metal is included in the alloy for absorbing that particular type of emission. A particular radiation absorbing metal for absorbing a particular radioactive emission will be referred to herein as a corresponding radiation absorbing metal for that emission. Similarly, a particular radioactive emission which may be absorbed by a particular radiation absorbing metal will be referred to herein as a corresponding radioactive emission for that radiation absorbing metal. Preferred radiation absorbing metals include particular isotopes of lead, beryllium, cadmium, vanadium, yttrium, ytterbium, zirconium, and tungsten. One or more of these radiation absorbing metals may be used within the scope of the invention depending upon the radioactive isotopes to be alloyed in the molten metal. For purposes of this disclosure and the accompanying claims, a "radiation absorbing metal" comprises a metal which is capable of capturing a particular expected radioactive emission, that is, a particular emission at a natural decay energy level.

As used in this disclosure and the following claims, the "type of expected radioactive emission" associated with an isotope in the waste material to be treated refers to the particular type of both primary and secondary emission (alpha, beta, gamma, or neutron) characteristic of the isotope and any daughter isotope, and the characteristic energy level of each emission. The "expected radioactive emission" refers to each respective emission within each type of emission. For the purposes of this disclosure and the claims, a "primary radioactive emission" comprises the emission or emissions directly from the radioactive decay of an isotope. For most radioactive isotopes, the primary radioactive emissions will include either an alpha or beta emission at a characteristic energy level and a gamma emission at a characteristic energy level. A "secondary radioactive emission," for the purposes of this disclosure, comprises a radioactive emission resulting from a primary radioactive emission. A secondary radioactive emission (commonly gamma radiation or a liberated neutron) is generated as a primary radioactive emission is absorbed by an absorbing material or as a primary radioactive emission otherwise interacts with matter.

Although the invention has particular application in treating mixed waste streams which include both radioactive and non-radioactive wastes, those skilled in the art will appreciate that a waste stream made up of only radioactive materials may be treated using the present process. The process according to the invention is useful for diluting and alloying the radioactive isotopes for storage even in the absence of non-radioactive wastes.

Regardless of the particular composition of the reactant alloy according to the invention, the alloy is heated to a molten state for receiving the waste stream. It is typically desirable to use the lowest reactant alloy temperature necessary to react any non-radioactive constituents in the waste stream and to efficiently melt or dissolve the radioactive material into the alloy. For mixed wastes which include organic constituents, a reactant alloy temperature of at least 770 degrees Celsius is generally required to quickly break the organic molecules down into the desired materials. Higher temperatures may be desirable to better dissolve or melt heavier radioactive isotopes such as transuranic elements.

In one preferred form of the invention, the reactant alloy is heated using fossil fuel burners. Other forms of the invention may employ an electrical induction heating system or any other suitable heating arrangement to heat the reactant metal alloy to the desired operating temperature. The waste material is introduced directly into the molten reactant alloy, preferably below the surface of the molten material.

The aluminum, magnesium, or lithium in the reactant alloy chemically strips chlorine or any other halogen atoms from organic molecules in the waste material to form a metal salt. Some of these metal salts may remain in a molten state and separate by gravity separation in the reactant alloy container. Other metal salts such as aluminum chloride, for example, along with carbon freed from the waste material in the form of elemental carbon and char go to a gaseous state at the temperature of the molten alloy. Gas released in the treatment process may be drawn off and scrubbed in an aqueous scrubber/separator to produce a slurry of char and salt solution. The salt solution may then be separated and processed to recover the salts and char. Each material produced in a reaction with a chemically active metal in the alloy will be referred to in this disclosure and the following claims as a reaction product.

In order to produce a mechanically stable ingot for long-term storage, the treatment process preferably includes maintaining a minimum ratio of radiation absorbing metal atoms to expected radioactive emissions. That is, the amount of radiation absorbing metal in the reactant alloy is varied as a function of the number of radioactive isotopes in the resulting alloy or as a function of the corresponding expected radioactive emissions in the volume of the resulting alloy. The preferred ratio comprises 727 or more atoms of radiation absorbing metal to the corresponding radioactive emission. This ratio produces an alloy in which radioactive emissions may be absorbed by the radiation absorbing metals without significantly degrading the mechanical integrity of the ingot.

The process according to the invention includes the step of identifying each type of radioactive isotope in the waste material to be treated and determining the amount of each identified radioactive material in a waste material. This identification step may be performed by any suitable means, preferably through mass spectroscopy performed on one or more samples of the waste material. The treatment process further includes using this information to build a particular reactant alloy for a selected volume of the waste material. Waste material is then metered into the reactant alloy using a suitable metering device to control the volume of waste material added the alloy.

Once the minimum ratio of radiation absorbing atoms to corresponding expected radioactive emissions is reached, the molten reactant alloy (now including radioactive isotopes) may be cooled to a solid form in one or more ingots. These ingots maintain their mechanical integrity and produce relatively few external emissions due to the radiation absorbing material and thus may be stored in relative safety. Each ingot is preferably encapsulated with a suitable radiation absorbing material or combination of materials. This encapsulant material should be capable of absorbing substantially each type of radioactive emission which could be produced within the ingot.

One advantage of the treatment process according to the invention is that it combines the separation of radioactive waste from non-radioactive wastes with the chemical treatment of non-radioactive wastes. Also, the ingots which result from the process are very stable. There is very little chance for release of the alloyed radioactive isotopes from the ingots. Furthermore, radioactive emissions from the ingots are reduced by the radiation absorbing metals which are distributed throughout the matrix of the alloy along with the radioactive isotopes. The radiation absorbing metals also serve to prevent the radioactive emissions from adversely affecting the other metals in the ingots and prevent significant mechanical degradation in the alloy material.

These and other objects, advantages, and features of the invention will be apparent from the following description of the preferred embodiments, considered along with the accompanying drawings.

DESCRIPTION OF THE PREFERRED EMBODIMENTS

Figure 1:
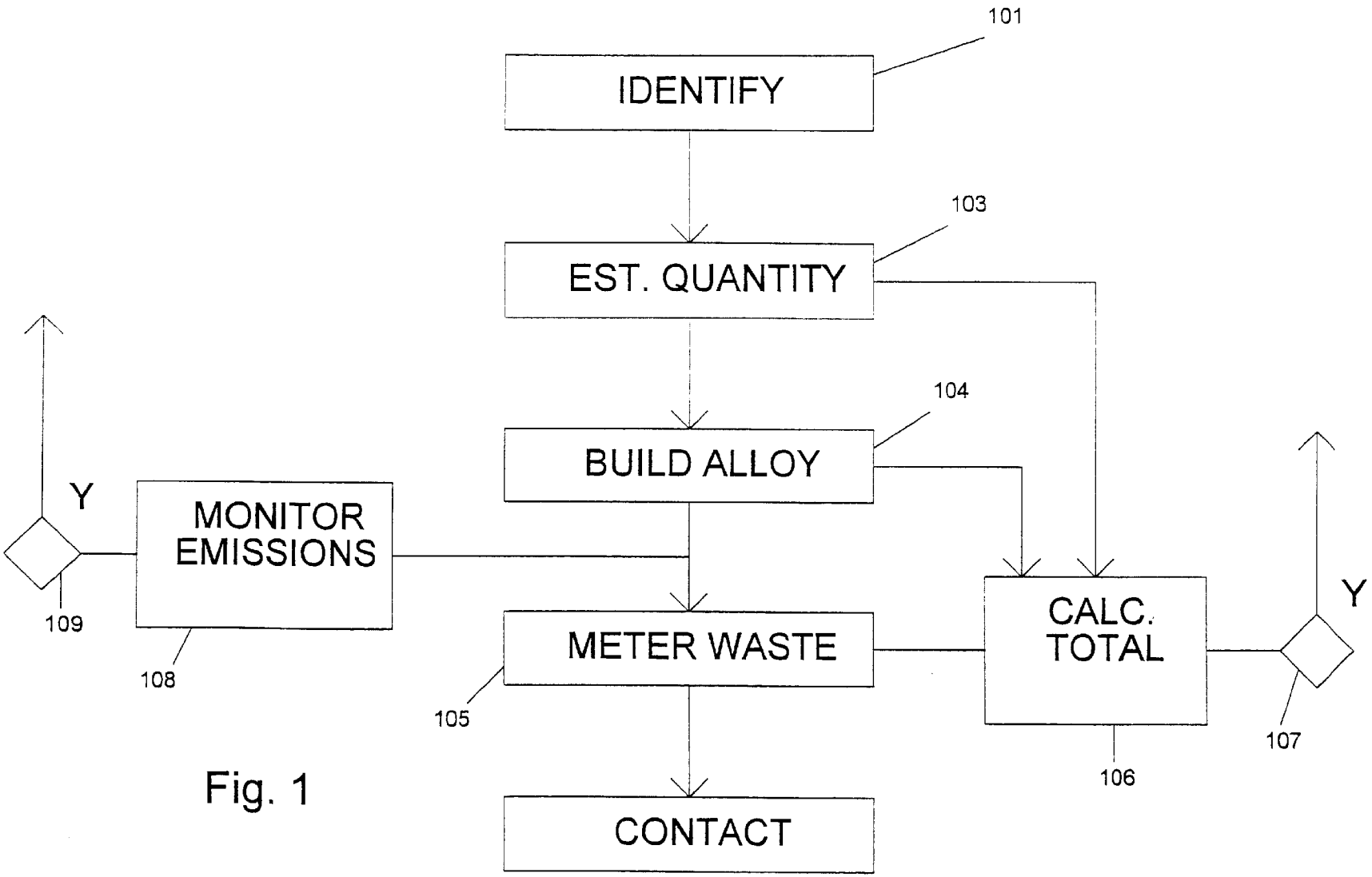
FIG. 1 is a block diagram showing a treatment process embodying the principles of the invention.

The invention utilizes a reactant alkaline metal alloy composition including one or more chemically active alkaline metals and one or more radiation absorbing metals. Alkaline metals are included for chemically reacting with hydrocarbon and other non-radioactive wastes in a waste stream and for facilitating the alloying of radioactive isotopes. Radiation absorbing metals generally do not react chemically in any substantial degree with any material in the waste stream and are included in the reactant alloy only for their radiation absorption characteristics. Also, the radiation absorbing metals are matched by their radiation absorption characteristics to radioactive isotopes to be added to the reactant alloy and, more particularly, to the radioactive emissions expected within the resulting alloy.

The chemically active alkaline metal or metals in the reactant alloy may comprise, aluminum, magnesium, lithium, calcium, iron, zinc, and copper. The aluminum, magnesium, and /or lithium in the reactant alloy react with halogenated hydrocarbons, to produce aluminum, magnesium, and/or lithium salts. Calcium, iron, zinc, and copper in the reactant alloy may react with certain non-radioactive constituents in the waste material, but are primarily included as stabilizing agents for the aluminum, magnesium, and/or lithium in the reactant alloy.

The radiation absorbing metal or metals in the reactant alloy may comprise particular isotopes of beryllium, cadmium, vanadium, yttrium, ytterbium, zirconium, tungsten, or lead. Various isotopes of these metals exhibit a low fission neutron cross section which allows them to absorb radioactive emissions to produce either a stable isotope or an isotope which emits only relatively low energy radiation. Table 1 shows a list of preferred radiation absorbing metals which may be employed in the reactant metal alloy within the scope of the invention. Table 1 also lists the particular radioactive emissions which each radiation absorbing metal is capable of absorbing. The particular radiation absorbing metal or metals chosen for an application will depend upon the nature of the radioactive isotopes in the waste stream being treated. Specifically, a radiation absorbing metal is included in the reactant alloy for each corresponding expected radioactive emission. Thus, for each type of expected radioactive emission associated with an isotope added to the alloy, an absorbing metal is included for absorbing that particular type of radioactive emission.

TABLE I

| ELEMENT | ISOTOPE | ABSORPTION CHARACTERISTIC |
|---|---|---|
| LEAD | 197–207 | GAMMA ABSORBER AT .72 MeV AND HIGHER |
| | 208–214 | BETA ABSORBER |

TABLE I-continued

| ELEMENT | ISOTOPE | ABSORPTION CHARACTERISTIC |
|---|---|---|
| TUNGSTEN | 173–183 | GAMMA ABSORBER |
| | 186–189 | BETA ABSORBER |
| | 184 | BETA AT .429 MeV |
| | 185 | GAMMA AT 0.075 MeV |
| VANADIUM | 46 | BETA AT 6.03 MeV AND GAMMA AT .511 MeV |
| | 47 | BETA AT 1.89 MeV AND GAMMA AT .511 MeV |
| | 48 | BETA AT .696 MeV AND GAMMA AT .511 MeV |
| | 50 | GAMMA AT .783 AND 1.55 MeV |
| | 52–54 | BOTH BETA AND GAMMA AT CERTAIN ENERGY LEVELS |
| YTTRIUM | 82–96 | BETA AT .008–3.06 MeV |
| | 89 | GAMMA AT .91 MeV |
| | 90 | GAMMA AT .202 MeV |
| | 91 | GAMMA AT .551 AND .534 MeV |
| | 95 | GAMMA AT 1.3 AND 1.8 MeV |
| YTTERBIUM | 154–164 | ALPHA |
| | 162 | BETA |
| | 175, 177 | BETA |
| | 166–169, 171, 176 | GAMMA |
| CADMIUM | 99–124 | BETA ABSORBER, NEUTRONS AT 2,200 M/SEC |
| BERYLLIUM | 8 | ALPHA ABSORBER |
| | 10–11 | ALPHA AND BETA ABSORBER |
| ZIRCONIUM | ALL | BETA ABSORBER AT 0.38 TO 0.65 MeV |

Those skilled in the art will appreciate that many of the above-identified preferred radiation absorbing metals are themselves unstable isotopes and are subject to radioactive decay. However, the emission energies associated with these isotopes are sufficiently low to avoid substantial radiation leakage from the resulting storage product and mechanical degradation of the storage product.

The alloy produced according to the invention includes sufficient radiation absorbing metal for each corresponding expected emission to maintain a minimum ratio of radiation absorbing metal atoms to the respective corresponding expected radioactive emissions. The preferred ratio is no less than seven hundred and twenty-seven (727) atoms of radiation absorbing metal for each corresponding expected radioactive emission. Higher ratios may also be used within the scope of the invention.

As radioactive isotopes are alloyed into the reactant alloy, the atoms of radioactive material are incorporated into the matrix of the reactant alloy and isolated among the atoms of metals in the reactant alloy. Most importantly, the atoms of radioactive isotopes are substantially distributed and isolated among the atoms of corresponding radiation absorbing metal in the alloy. As used herein to describe the radioactive isotopes added to the molten metal bath, the term "alloyed" means dissolved or otherwise dispersed and intimately mixed with the molten reactant metal. This dispersion and resulting isolation of the radioactive isotopes in the reactant alloy matrix among the corresponding radiation absorbing metals at the desired minimum ratio helps ensure that most radioactive emissions from the radioactive isotopes will be captured within the reactant alloy storage product, thereby reducing overall radioactive emissions from the storage product. The specific absorbing metals absorb the radioactive emissions without substantially reducing the mechanical integrity of the storage product.

The reactant alloy may include one or more of the following chemically active alkaline metals in the indicated concentration range: between about 1% to 25% zinc, between about 1% to 25% calcium, between about 1% to 25% copper, between about 1% to 25% magnesium, between about 1% to 25% lithium, and between about 10% to 90% aluminum. The reactant alloy may include one or more of the following radiation absorbing metals: lead, tungsten, beryllium, cadmium, vanadium, yttrium, ytterbium, and zirconium. Each of these radiation absorbing metals will commonly be present in the reactant alloy in a concentration range of between about 1% to 25% of the total alloy. All percentages used in this disclosure are by weight of the total reactant alloy. Table 2 sets out nine different preferred reactant alloys tailored for various waste streams. Each percentage in Table 2 refers to the percentage of a particular radiation absorbing isotope chosen from Table 1. Table 3 indicates the particular applications for which the alloys shown in Table 2 are tailored.

TABLE 2

| | I | II | III | IV | V | VI | VII | VIII | IX |
|---|---|---|---|---|---|---|---|---|---|
| Zinc | 3 | 2 | 5 | — | — | — | — | 3 | — |
| Calcium | 2 | 2 | 3 | — | — | — | — | 2 | — |
| Copper | 2 | 2 | 3 | — | — | — | — | 2 | — |
| Magnesium | 10 | 3 | — | — | — | — | — | 3 | — |
| Lead | 42 | — | — | 25 | 20 | — | 25 | 8 | 25 |
| Aluminum | 41 | 51 | 50 | 50 | 40 | 60 | 50 | 30 | 50 |
| Lithium | — | — | 4 | — | — | — | — | 10 | — |
| Beryllium | — | 40 | — | 25 | 20 | 15 | — | 10 | — |
| Vanadium | — | — | 35 | — | 20 | 10 | 25 | 10 | 13 |
| Yttrium | — | — | — | — | — | 5 | — | 10 | — |
| Zirconium | — | — | — | — | — | 10 | — | 10 | — |
| Tungsten | — | — | — | — | — | — | — | 2 | 12 |

Reactant alloys III, VI, and VII are preferably used at an operating temperature of about 1000 degrees Celsius. Reactant alloy IV is preferably used in the process of the invention at an operating temperature of 850 degrees Celsius, while alloy V is used at an operating temperature of 900 degrees Celsius. The operating temperature for a particular treatment process according to the invention is chosen based both upon the constituents of the waste stream and the reaction products to be produced in the process. Higher operating temperatures may be required to break double and triple carbon bonds and other types of chemical bonds in the molecules of waste material being treated. Higher operating temperatures also generally allow the radioactive constituents in the waste stream to better dissolve or melt into the reactant metal alloy. Also, the operating temperature may be increased to allow certain reaction products to go to a gaseous state and then be removed from the reactant alloy container in the gaseous form.

TABLE 3

| Alloy | Waste Stream |
|---|---|
| I | Dioxins, organic compounds, gamma emitters |
| II | Chlorinated hydrocarbons, alpha emitters |
| III | Chlorinated hydrocarbons, beta emitters |
| IV | Halogenated hydrocarbons, gamma emitters, and alpha emitters |
| V | Halogenated hydrocarbons, alpha emitters, beta emitters, and gamma emitters |
| VI | Hydrocarbons, halogenated hydrocarbons, and multiple types radioactive isotopes |
| VII | Many mixed wastes, alpha emitters, and gamma emitters |
| VIII | Many mixed wastes including polychlorinated biphenyls, dioxins, PCP, battery mud, chrome plating salts, inks, solid rocket fuels, dyes, alpha emitters, beta emitters, and gamma emitters |
| IX | Mixed halogenated hydrocarbons, beta emitters, and gamma emitters. |

Another preferred reactant alloy according to the invention is tailored for processing waste streams containing relatively high gamma radiation emitting isotopes at 0.72 MeV and higher. This preferred alloy includes about 25% lead (197–207), about 25% tungsten (173–183), and about 50% chemically active metal. The chemically active metal may comprise aluminum and/or magnesium.

As indicated by the example reactant metal alloys shown in Tables 2 and 3 and discussed above, the amount of chemically reactive metal in the alloy preferably always makes up approximately 40% or more of the alloy by weight. This level of chemically active metal in the reactant alloy is helpful in dissolving the metal radioactive constituents in the waste stream. The dissolved radioactive constituents may then be dispersed freely throughout the molten metal to produce the desired storage alloy.

The radioactive material storage product comprises one or more chemically active metals and one or more radioactive isotopes. Also, for each type of expected radioactive emission in the volume of the storage product, the product further includes a corresponding radiation absorbing metal adapted to absorb the respective radioactive emission. The corresponding radiation absorbing metal may be adapted to absorb radioactive emissions from different isotopes, and thus the storage product will not always include a separate radiation absorbing metal for each isotope. Rather, one radiation absorbing metal may be capable of absorbing two or more types (that is, type and energy level) of radioactive emissions in the storage product. In any event, the storage product includes at least about 727 atoms of radiation absorbing metal for each corresponding expected radioactive emission.

With each reactant metal alloy composition according to the invention, the alloy is heated to a molten state to prepare the material for receiving the waste stream. Typically, the temperature of the molten alloy must be maintained at no less than 770 degrees Celsius in order to provide the desired reaction with organic molecules in the waste material. Higher temperatures for the molten alloy may also be used within the scope of the invention as discussed above with reference to Table 3. Lower temperatures may also be used where relatively few non-radioactive constituents are included in the waste stream or only relatively light hydrocarbons are included in the waste. In any event, the operating temperature should be a temperature sufficient to place the particular reactant metal alloy in a molten state and sufficient to allow the radioactive metals in the waste material to dissolve or melt into the bath.

The reactant metal alloy treatment process according to the invention may be used to treat many types of radioactive waste materials and mixed waste streams including both radioactive waste and non-radioactive waste. The treatment process is particularly well adapted for treating wastes which include radioactive constituents mixed with halogenated hydrocarbons. The radioactive isotopes may comprise any isotopes which may be alloyed into the particular molten reactant metal including, for example, isotopes of plutonium, radium, and rhodium.

Certain radioactive isotopes may not alloy into the molten reactant metal. Where these isotopes react with metals in the bath to form reaction products which remain in solid or molten form, these reaction products may be thoroughly mixed with the molten reactant metal and then cooled while mixed to produce relatively low emission ingots. Any gaseous reaction products which include radioactive isotopes will be entrained with the non-radioactive gaseous reaction products. Some gaseous radioactive isotopes may be absorbed from the reaction product gas. For example, tritium may be absorbed by palladium placed in the stream of gaseous reaction products. However, it is desirable to maintain the operating temperature of the molten reactant metal low enough to reduce the amount of radioactive isotopes which go into gaseous reaction products. For example, where a radioactive isotope of iodine is included in the waste stream, the chemically active metal in the alloy may include aluminum and the operating temperature is maintained low enough to ensure that the resulting aluminum iodide remains primarily in a molten state.

The aluminum, magnesium, or lithium in the reactant alloy according to the invention strips halogens from the halogenated hydrocarbons in the waste stream to produce halogen salts. Other elements in the non-radioactive waste material, such as phosphorous, sulphur, and nitrogen, are also stripped from the carbon atoms in the waste material. Much of this other stripped material forms metal salts (sulfates, nitrates, phosphates) which separate from the molten reactant metal by their respective density. Where these separated materials include only non-radioactive constituents they may be separately drawn or scraped from the molten reactant metal by any suitable means. Most of the halogen salts and char go to a gaseous state and are drawn off for separation and recovery. Any low boiling point metals, such as arsenic or mercury, for example, which are liberated from the waste materials are also drawn off in a gaseous state for recovery. Non-radioactive, relatively high boiling point metals such as chromium, and radioactive metals in the waste material remain safely in the molten alloy. The original metals which make up the alloy remain in the molten alloy unless consumed in the formation of salts and small quantities of oxides.

The treatment process according to the invention is illustrated in FIG. 1. The waste material to be treated is first analyzed to identify the types and concentrations of non-radioactive chemicals and radioactive isotopes present in the waste. This analysis step is shown at dashed box 101 in FIG. 1. Information regarding the types and concentrations of non-radioactive constituents in the waste material is used to help choose the types of chemically active metals to be included in the molten reactant alloy. Information regarding the radioactive isotopes in the waste material determines the amount and type of radiation absorbing metals to be included in the molten reactant alloy.

The types and concentrations of radioactive isotopes and non-radioactive chemicals in the waste material are preferably determined using an analytical technique such as mass spectroscopy at step 101. Of course, any analytical technique will be limited to certain minimum detection levels below which an isotope or chemical cannot be detected. The concentration of radioactive isotopes detected in the waste stream is then used at step 103 to produce an estimate of the quantity or amount of each radioactive isotope present in the waste per unit volume or weight.

Once the amount and type of non-radioactive constituents and radioactive isotopes in the waste material are known, the reactant metal alloy for treating a selected volume or weight of the particular waste material is constructed at step 104. Specifically, a reactant metal alloy is built with chemically active metals for reacting with the non-radioactive constituents in the waste material and with sufficient radiation absorbing metals to produce the desired storage product.

With the reactant alloy built for the particular waste and held in a molten state at the desired operating temperature, the process includes metering the waste material into the molten reactant metal at step 105. Any suitable metering device may be used to perform the metering step according to the invention. Preferably, the metering device provides a continuous output of volumetric information (or weight information if it is desired to meter the waste stream by weight). Since the amount of waste material which may be added to the molten reactant alloy to produce the desired storage product (desired minimum ratio) is known, waste material may be metered into the reactant alloy until that known amount is reached. Alternatively, the continuous output showing the cumulative amount of waste added to the reactant alloy may be used at step 106 to calculate the total radioactive isotopes in the alloy and the ratio of radiation absorbing atoms to corresponding expected radioactive emissions at step 106. This calculation step also requires the radioactive isotope concentration or amount information from step 103 and the alloy information from step 104. The calculation may be performed using a suitable processor (not shown) connected to receive the required inputs, or may be performed manually. The calculated ratio or the cumulative amount may be compared to a corresponding set value at step 107 to provide a control signal which may be used to automatically stop the introduction of waste material into the reactant alloy.

The metered amount of waste material is added to the molten reactant metal at step 108 in FIG. 1. Also, the preferred form of the invention includes a separate emission monitoring step to monitor radioactive emissions from the waste material stream as it is being directed to the molten reactant alloy. This separate monitoring step, 108 in FIG. 1, may be performed is using any suitable radioactive emission detector to detect anomalous high concentrations of radioactive isotopes. Suitable devices include gas-filled, scintillation, or semiconductor type detectors. Regardless of the detector type, an unexpected spike in radioactive emissions may be used at decision box 109 to produce a control signal to stop the waste stream from being introduced into the reactant alloy. This control signal may be automated or may be made manually by an operator overseeing the treatment process.

In the preferred treatment process according to the invention, the reactant metal alloy composition is contained in a reactant alloy container such that the alloy is substantially isolated from oxygen. The reactant alloy is then heated by a suitable heating arrangement to the desired operating temperature, which is generally greater than 770 degrees Celsius as discussed above. Any remaining oxygen in the reactor vessel quickly reacts with the metal in the alloy to produce metal oxides which appear as slag at the surface of the molten material or sink to the bottom of the reactant alloy container. In the preferred process, a layer of pure carbon in the form of graphite is placed at the surface of the molten reactant metal alloy. The graphite layer may be from approximately one-quarter inch to several inches thick and helps further isolate the molten alloy from any oxygen which may be in the reactant alloy container.

Once the molten alloy reaches the desired operating temperature, the waste material is introduced into the reactant molten alloy to perform the contacting step shown in FIG. 1. The waste material is preferably introduced below the surface of the molten alloy but may be introduced at the surface of the alloy within the scope of the invention. The temperature of the metal alloy is maintained at least at the desired operating temperature as waste material is added to the molten alloy. Heat will commonly need to be added continuously by the heating arrangement in order to maintain the desired operating temperature. Also, it will be appreciated that pockets of relatively cooler areas may form momentarily in the reactant alloy as waste material is added. The bulk of the reactant alloy, however, is maintained at least at the desired operating temperature. A suitable mixing arrangement may be used with the reactant alloy container to ensure that the relatively cool waste material is distributed quickly within the reactant alloy and to ensure that the radioactive isotopes and radiation absorbing metals are evenly distributed within the alloy. A mechanical stirring device (not shown) to continuously stir the molten material provides a suitable mixing arrangement.

Once the desired minimum level of radiation absorbing metal to corresponding expected radioactive emissions is reached for a given volume of reactant alloy according to the invention, the waste stream is halted and the reactant alloy cooled to form one or more solid ingots of the storage material. Where isotopes of cadmium are to be included in the storage product, it is necessary to cool the molten metal to a temperature low enough to allow the cadmium to go to a molten form (725 to 765 degrees Celsius). Thereafter, the molten material may be thoroughly mixed prior to further cooling. The resulting solid ingots each include unreacted alkaline metals, the radiation absorbing metals, and the radioactive isotopes from the waste stream, all substantially evenly distributed. Each ingot is preferably encapsulated with a radiation absorbing encapsulant material for storage. The encapsulant material preferably includes a material or combination of materials which together are capable of absorbing each type of radioactive emission expected from the resulting ingot.

Figure 2:
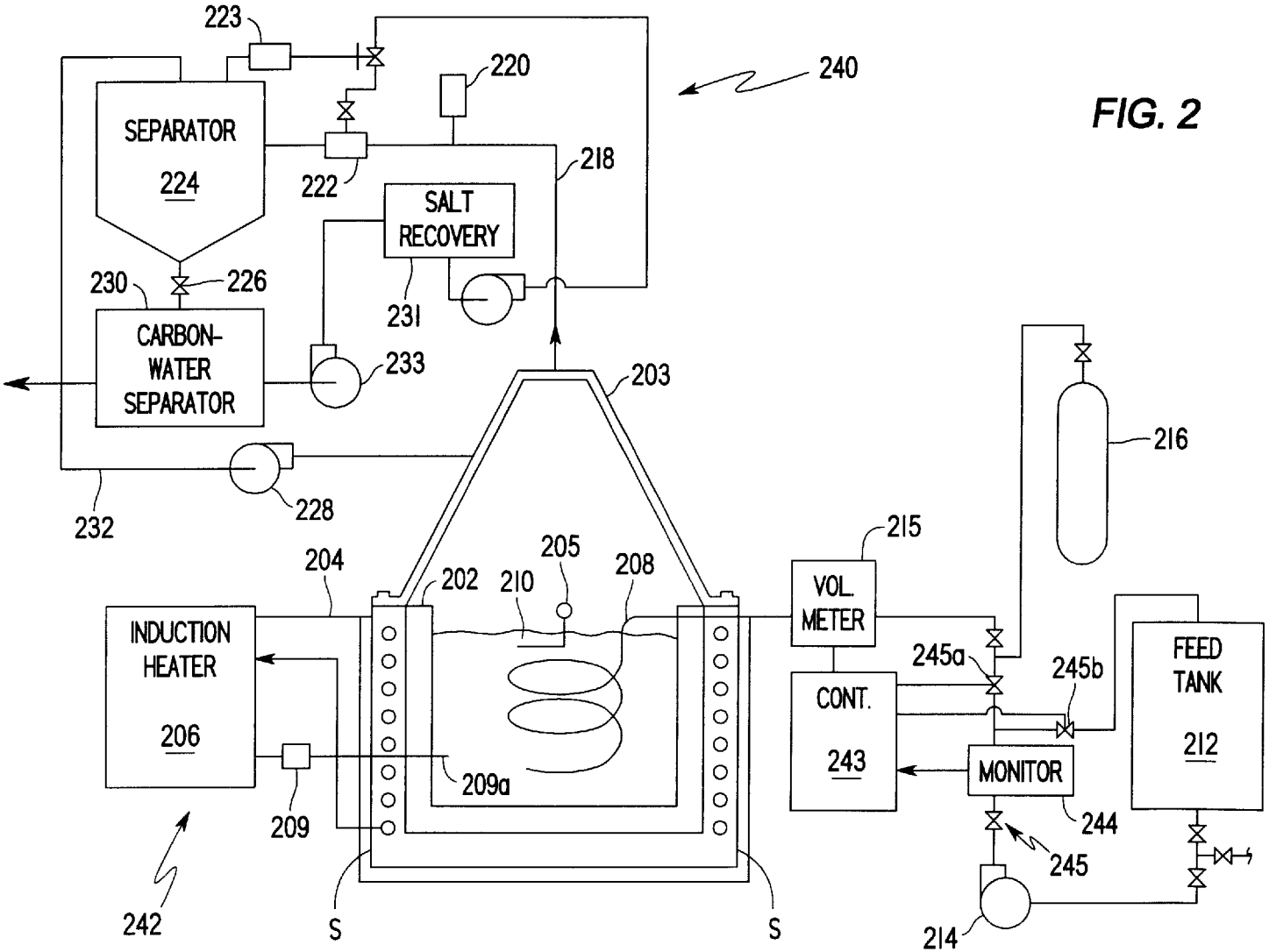
FIG. 2 is a diagrammatic representation of an apparatus for performing the treatment process shown in FIG. 1.

FIG. 2 shows an apparatus for performing a treatment process embodying the principles of the invention. The apparatus includes a reactant alloy container 202, a recovery/recirculation arrangement 240, a feed arrangement 241, and a heating arrangement 242. The reactant alloy container 202 is preferably built from a suitable metal which will maintain structural integrity at the desired elevated temperatures. However, due to the highly reactive nature of the alloy 210, the reactant alloy container 202 is lined with a ceramic or other suitable refractory material to prevent the metal of the container from reacting with the reactant alloy. Also, due to the radioactive material to be alloyed in the process, container 202 also preferably includes a layer S of suitable radiation absorbing shielding. This shielding is adapted to block or absorb each type of radioactive emission which may emanate from the interior of container 202. A cover 203 is connected over container 202 for collecting gaseous reaction products and helping to isolate the metal bath from oxygen. Although not shown in the drawing, radiation shielding material is also preferably included in cover 203 and with the feed arrangement 241.

An expendable hook 205 may be placed in the alloy 210 at the termination of the process and, after cooling, may be used to lift the solidified alloy ingot from the reactant alloy container 202. Alternatively, a suitable drain may be included in container 202 for draining off reactant alloy once the desired minimum ratio of radiation absorbing atoms to corresponding radioactive emissions is reached.

Solids may be mixed with liquids to form a slurry and the slurry introduced similarly to liquid wastes as discussed below. Also, solids either alone or in the form of a slurry may be introduced into the container 202 through an auger arrangement or other suitable arrangement such as that shown in U.S. Pat. No. 5,431,113, the disclosure of which is hereby incorporated herein by this reference.

The heating arrangement 242 includes an induction heater, including an induction heater power supply 206 and induction coils 204 built into the reactant alloy container 202. The coils 204 may be water-cooled and the water may be used to cool the reactant alloy 210 as desired, either during the treatment process or at the completion of the treatment process. The induction heater arrangement 242 includes a heater control 209 with a suitable sensor 209*a* inside the reactant alloy container 202 for controlling the induction heater and maintaining the temperature of the metal alloy 210 at the desired operating temperature. Although the induction heating arrangement is illustrated in FIG. 1, any suitable heating arrangement, including a fossil fuel burning heater may be used to heat the alloy 210 to the desired temperature. U.S. Pat. No. 5,452,671 to the present inventor illustrates a fossil fuel fired heating arrangement which may be used according to the present invention. The disclosure of U.S. Pat. No. 5,452,671 is hereby incorporated herein by this reference.

The feed arrangement 241 includes feed tank 212 and feed coil 208. Feed tank 212 contains waste material to be processed. A feed pump 214 pumps the waste material from feed tank 212 to the reactant alloy container 202 through a metering device 215. Metering device 215 serves two functions. First, metering device 215 is operated to meter waste material into the reactant alloy at a rate which does not exceed the capacity of the heater arrangement 242 to maintain the desired operating temperature in the molten reactant metal 210. Second, metering device 215 provides information regarding the amount of waste material added to the molten reactant metal. This quantity information may be used to calculate the ratio of radiation absorbing atoms in the alloy 210 to the atoms of corresponding expected radioactive emissions. As described above with reference to FIG. 1, the ratio calculations are preferably computed automatically and continuously in a suitable control processor shown at reference number 243 in FIG. 2. Control processor 243 also receives information concerning the radiation absorbing metals in container 202 and information concerning the concentration (or amount) of various radioactive isotopes in the waste material to be treated. Alternatively to calculating the ratio as waste material is being added to the molten metal bath, the quantity information used to build the molten reactant alloy can be used to limit the amount of waste material metered through metering device 215.

Feed system 241 also preferably includes a radioactive emission monitoring device 244 connected in position to monitor the stream of waste material being directed to the molten metal 210 for treatment. Monitoring device 244 may be located in a recirculation manifold shown generally at 245. Should monitoring device 244 detect a spike in radioactive emissions from the waste stream, controller 243 (or an operator) may close valve 245*a* and open valve 245*b* to circulate the waste stream back to feed tank 212. Alternatively to the manifold arrangement, the feed pump 214 can simply be turned off to halt the flow of waste material into the reactant alloy 210.

Feed coil 208 is coated on its interior and exterior surfaces or formed from a ceramic or other suitable refractory material to prevent the coil from reacting with the molten alloy 210 in container 202. The outlet end of the coil is preferably positioned well below the surface of the alloy 210 to ensure good contact between the waste material and molten reactant metal 202. The feed system 241 also preferably includes a gas purging arrangement including a gas storage cylinder 216 for containing a suitable purge gas such as nitrogen. The gas purging arrangement is operated to purge the feed lines and coil 208 of air prior to operation of the system. Gases other than nitrogen may be used to purge the system of oxygen, including flue gases from a fossil fuel burning heater arrangement.

The recovery/recirculation system 240 includes an aqueous scrubber/separator 224, a char/water separator 230, a salt recovery arrangement 231, and a recirculation arrangement 232. Off-gas from the area above the molten alloy 210 in container 202 comprising gaseous halogen salts, char, and other gases are drawn off through line 218. Line 218 is preferably made of stainless steel and includes a relief valve 220 to maintain atmospheric pressure on line 218. A water spray nozzle 222 is associated with the scrubber/separator 224 and serves to spray water into the off-gas at the inlet to the scrubber/cyclone separator. The water sprayed into the off-gas causes the char to coalesce while the salt in the off-gas goes into solution in the water. The amount of water supplied through nozzle 222 is preferably controlled with temperature controller 223 to maintain the temperature below about 100 degrees Celsius in the scrubber/separator 224. A char slurry forms in the bottom of the scrubber/separator 224 and is drawn off through valve 226. The slurry comprises char and water with salt in solution. The char slurry is directed to char/water separator 230 which separates out the fine char particles from the water solution and passes the water solution through pump 233 on to salt recovery system 231. Salt recovery system 231 may comprise an evaporative system. Water from salt recovery system 231 may be recycled to nozzle 222. Any gas from separator/scrubber 224 may be vented to the atmosphere through a suitable radiation monitoring arrangement (not shown). Alternatively, gas from separator/scrubber 224 may be drawn off through recirculation fan 228 and reintroduced to the area above the molten alloy 210 for recycling through the system.

EXAMPLE I

A waste material is analyzed with a mass spectrometer and found to comprise thorium 229 at 9 parts per million (ppm), PCBs at 500 ppm, and creosote at 1000 ppm in water. To treat one ton of the waste material, a molten reactant metal according to the invention may include predominantly aluminum and perhaps small percentages of zinc, iron, copper, and calcium. The primary emissions of thorium 229 include alpha particles at 5.168 MeV. Beryllium 11 is added to the molten reactant metal as a corresponding absorber for the alpha emissions and lead 206 is added to absorb the primary gamma emissions from the thorium 229 and secondary gamma emissions as the alpha particles interact with materials in the bath. The 9 ppm of thorium 229 equates to 6.412 grams of the isotope per ton of the waste material. 6.42 kilograms of beryllium 11 is included in the metal bath to provide a one thousand to one correspondence between the beryllium and the expected alpha emissions. 12.84 kilograms of lead 206 is included in the metal bath to provide a one thousand to one correspondence between the lead and the expected primary and secondary gamma emissions.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the invention is described above with the reactant alloy being heated to a molten state in the reactant alloy container, the alloy constituents may be heated to a molten state together or individually outside the reactant alloy container and added to the container as a molten material. Heating the reactant alloy metals outside of the reactant alloy container is to be considered an equivalent to the embodiment in which the metals are initially heated to the molten state within the reactant alloy container. Furthermore, constituents of the desired reactant metal alloy may be added while the waste material is being added. Adjusting the reactant alloy of the bath after some waste material has been added is to be considered equivalent to adding the waste material to a completely pre-built reactant metal bath. Also, numerous solid and liquid recovery arrangements may be used within the scope of the invention instead of the example arrangement 240 shown in FIG. 2.

What is claimed is:

1. A method for treating a waste material which includes at least one type of radioactive isotope to be alloyed with a reactant metal alloy, the method comprising the steps of:

(a) identifying each radioactive isotope which is present in the waste material at a detectable level and determining the concentration of each said radioactive isotope in the waste material;

(b) producing the reactant metal alloy for a selected volume of the waste material, the reactant metal alloy being held in a molten state and including at least one chemically active metal and, for each type of expected radioactive emission associated with the selected volume of the waste material, at least one corresponding radiation absorbing metal, each corresponding radiation absorbing metal being capable of absorbing the respective type of expected radioactive emission; and (c) adding the selected volume of the waste material to the molten reactant metal alloy.

2. The method of claim 1 wherein the molten reactant metal alloy includes a sufficient quantity of each corresponding radiation absorbing metal so that, once the selected volume of waste material has been added to the molten reactant metal alloy, the molten reactant metal alloy includes a minimum ratio of atoms of each corresponding radiation absorbing metal to each expected radioactive emission within the volume of the molten reactant metal alloy, the minimum ratio being no less than seven hundred and twenty-seven (727) corresponding radiation absorbing atoms for each respective expected radioactive emission.

3. The method of claim 1 further comprising the step of:

(a) maintaining the amount of the chemically active metal in the molten reactant metal alloy at no less than forty percent of the total molten reactant metal alloy by weight.

4. The method of claim 1 further comprising the step of:

(a) maintaining the molten reactant metal alloy at an operating temperature of no less than 770 degrees Celsius as the waste material is added to the molten reactant metal alloy.

5. The method of claim 1 wherein each chemically active metal is selected from the group consisting of magnesium, aluminum, lithium, zinc, calcium, and copper.

6. The method of claim 1 further comprising the step of:

(a) monitoring radioactive emissions from a stream of the selected volume of waste material being directed to the molten reactant metal alloy to be added thereto, the monitoring providing an indication of the level of radioactive emissions from the stream of waste material; and (b) halting the stream of waste material in response to an anomalous radioactive emission level detected from the stream of waste material.

7. A method for treating a waste material which includes at least one type of radioactive isotope to be alloyed with a reactant metal alloy, the method comprising the steps of:

(a) identifying each radioactive isotope which is present in the waste material at a detectable level and determining the amount of each said radioactive isotope in the waste material;

(b) producing the reactant metal alloy for a selected volume of the waste material, the reactant metal alloy being held in a molten state and including at least one chemically active metal and, for each type of expected radioactive emission associated with the selected volume of the waste material, at least one corresponding radiation absorbing metal, each corresponding radiation absorbing metal being capable of absorbing the respective type of expected radioactive emission; and (c) adding the selected volume of the waste material to the molten reactant metal alloy.

8. The method of claim 7 wherein the molten reactant metal alloy includes a sufficient quantity of each corresponding radiation absorbing metal so that, once the selected volume of waste material has been added to the molten reactant metal alloy, the molten reactant metal alloy includes a minimum ratio of atoms of each corresponding radiation absorbing metal to each expected radioactive emission within the volume of the molten reactant metal alloy, the minimum ratio being no less than seven hundred and twenty-seven (727) corresponding radiation absorbing atoms for each respective expected radioactive emission.

9. The method of claim 7 further comprising the step of:

(a) maintaining the amount of the chemically active metal in the molten reactant metal alloy at no less than forty percent of the total molten reactant metal alloy by weight.

10. The method of claim 7 further comprising the step of:

(a) maintaining the molten reactant metal alloy at an operating temperature of no less than 770 degrees Celsius as the waste material is added to the molten reactant metal alloy.

11. The method of claim 7 wherein each chemically active metal is selected from the group consisting of magnesium, aluminum, lithium, zinc, calcium, and copper.

12. The method of claim 7 further comprising the step of:

(a) monitoring radioactive emissions from a stream of the selected volume of waste material being directed to the molten reactant metal alloy to be added thereto, the monitoring providing an indication of the level of radioactive emissions from the stream of waste material; and (b) halting the stream of waste material in response to an anomalous radioactive emission level detected from the stream of waste material.

* * * * *